US009169441B2

(12) United States Patent
Stauffer

(10) Patent No.: US 9,169,441 B2
(45) Date of Patent: Oct. 27, 2015

(54) EXTRACTION OF BITUMEN FROM OIL SANDS

(76) Inventor: John E. Stauffer, Greenwich, CT (US)

( * ) Notice: Subject to any disclaimer, the term of this patent is extended or adjusted under 35 U.S.C. 154(b) by 805 days.

(21) Appl. No.: 13/306,363

(22) Filed: Nov. 29, 2011

(65) Prior Publication Data

US 2012/0074045 A1 Mar. 29, 2012

Related U.S. Application Data

(63) Continuation of application No. 12/260,313, filed on Oct. 29, 2008.

(51) Int. Cl.
*C10G 1/04* (2006.01)
*C10G 1/00* (2006.01)

(52) U.S. Cl.
CPC *C10G 1/002* (2013.01); *C10G 1/04* (2013.01); *C10G 2300/44* (2013.01)

(58) Field of Classification Search
USPC ..... 208/390, 391, 131, 132
See application file for complete search history.

(56) References Cited

U.S. PATENT DOCUMENTS

| | | | | |
|---|---|---|---|---|
| 3,811,506 | A | 5/1974 | Carlin | |
| 3,976,562 | A * | 8/1976 | Eberly, Jr. | 208/216 R |
| 4,206,036 | A * | 6/1980 | Takeuchi et al. | 208/216 R |
| 4,212,771 | A | 7/1980 | Hamner | |
| 4,229,281 | A | 10/1980 | Alquist et al. | |
| 4,300,999 | A | 11/1981 | Davies et al. | |
| 4,347,118 | A * | 8/1982 | Funk et al. | 208/390 |
| 4,487,687 | A * | 12/1984 | Simo et al. | 208/56 |
| 4,532,024 | A | 7/1985 | Haschke et al. | |
| 4,676,889 | A | 6/1987 | Hsieh et al. | |
| 6,090,274 | A | 7/2000 | Wu et al. | |
| 2002/0104799 | A1 | 8/2002 | Humphreys | |
| 2008/0149542 | A1 | 6/2008 | Bjornson et al. | |
| 2008/0210602 | A1 | 9/2008 | Duyvesteyn | |
| 2008/0223757 | A1 | 9/2008 | Ozum | |

FOREIGN PATENT DOCUMENTS

| | | |
|---|---|---|
| GB | 450721 | 2/1936 |

* cited by examiner

*Primary Examiner* — Michelle Stein
(74) *Attorney, Agent, or Firm* — Young Basile Hanlon & Macfarlane P.C.

(57) ABSTRACT

Carbon disulfide is used as a solvent to extract bitumen from oil sands in an anhydrous countercurrent flow process that is compatible with existing procedures for upgrading bitumen. The solution is then treated in a thermal reaction to reduce viscosity and then fractionated to recover the bitumen.

4 Claims, 1 Drawing Sheet

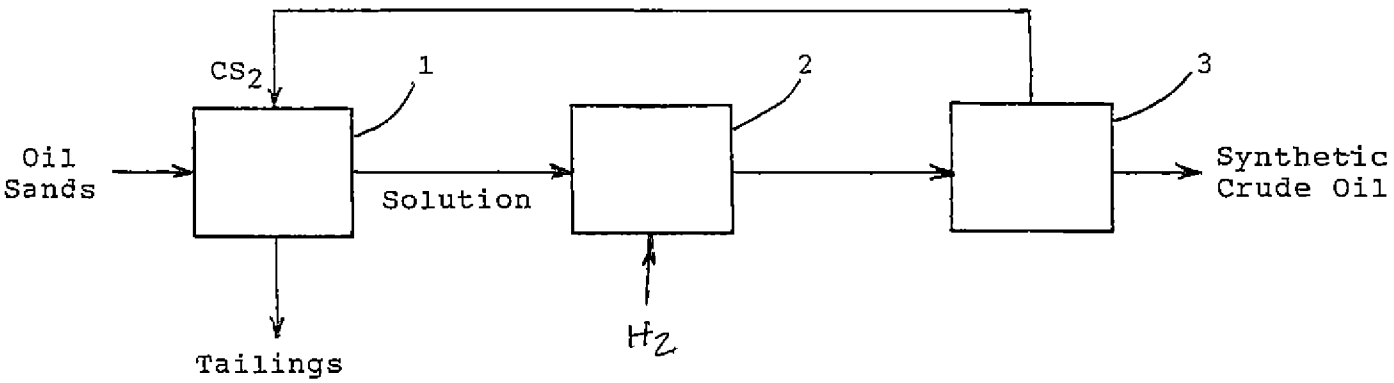
Oil Sands
$CS_2$
1
Solution
Tailings
2
$H_2$
3
Synthetic Crude Oil

EXTRACTION OF BITUMEN FROM OIL SANDS

CROSS REFERENCE TO RELATED APPLICATION

This application is a continuation of the co-pending U.S. patent application Ser. No. 12/260,313 filed Oct. 29, 2008.

FIELD OF THE INVENTION

A process is provided for the extraction of bitumen from oil sands employing carbon disulfide as a solvent. In the process, oil sands are contacted with carbon disulfide to dissolve the hydrocarbon contained in the sands. Next, the resulting solution of hydrocarbon is treated to reduce viscosity, and then fractionated to recover the bitumen.

BACKGROUND OF THE INVENTION

Oil sands are growing in importance as a source of petroleum. Oil sands are found in various parts of the globe, but the most significant deposits occur in northern Alberta, Canada, along the Athabasca River. The composition of oil sands is a mixture of quartz, clay, water and about ten percent heavy oil with a consistency of tar and known in the industry as bitumen.

The accepted practice for extracting bitumen from oil sands is to mix the sands with hot water and caustic to form an oil emulsion that is siphoned off from the solids. The mineral tailings are discarded after about 95 percent of the oil has been recovered. The extracted oil is upgraded by one of two processes to produce a synthetic crude oil that is suitable for refining at a later stage.

While current technology is workable, it has some drawbacks, particularly as practiced on a large scale. Water pollution is caused by the discharge of substantial quantities of wastewater. The energy efficiency of the process is poor. Lastly, the required investment in plant and equipment is considerable.

The object of the present invention is to provide an improved bitumen extraction process which is more cost-effective, meets environmental concerns and provides a product of the highest quality. This object, as well as other features and advantages of the present invention, will be apparent from the following description which is based on the single drawing FIGURE that is included.

Other applications of the present invention will become apparent to those skilled in the art when the following description of the best mode contemplated for practicing the invention is read in conjunction with the accompanying drawing.

SUMMARY OF THE DISCLOSURE

The present invention comprises steps for the extraction of bitumen from oil sands. First, the oil sands are mixed with carbon disulfide to dissolve the oil and extract it from the solid material. Next, the solution is treated to reduce viscosity, and finally the solution is fractionated to recover the bitumen. The treatment to reduce viscosity is preferably carried out by way of a thermal reaction.

The process is carried out for the most part under anhydrous conditions. In this manner, water pollution from the discharge in tailings is avoided. Additionally, the recovery of oil is enhanced. Finally, by recycling carbon disulfide to the extraction steps, its consumption is kept to a minimum.

BRIEF SUMMARY OF THE DRAWING

The description herein makes reference to the accompanying drawing wherein like reference numerals refer to like parts throughout the several views and wherein:

FIG. 1 is a block diagram showing three steps of the process, including extraction, fractionation, and hydrotreating.

DETAILED DESCRIPTION OF THE PROCESS

The oil contained in oil sands is a heavy, viscous hydrocarbon mixture not unlike tar. With the nomenclature of bitumen, this oil contains molecules with twenty or more carbon atoms. By contrast, light sweet crude, the premium feed to refineries, is mostly made up of compounds with five to twenty carbon atoms. Bitumen is further characterized by its content of aromatic compounds in addition to aliphatic hydrocarbons. Bitumen also contains substantial quantities of bound sulfur.

Given the nature of bitumen, this raw material presents difficult problems in its recovery from oil sands. As already mentioned, the prior art depends on forming a water-oil suspension that is separated from the solids by flotation. Alternatively, bitumen can be heated to a high temperature, in excess of 538° C., to reduce its viscosity to a point where it will flow. This approach is used for in-situ recovery of oil from oil sands that lie too deep in the ground to be dug up by strip mining.

For this process, I use carbon disulfide as a solvent for the bitumen. Carbon disulfide is an excellent solvent for this purpose: it is completely miscible with hexane as well as xylene. Up to 20 gm. of paraffin wax and as much as 40 gm. of naphthalene can be dissolved in 100 gm. of carbon disulfide at 20° C.

The low viscosity of carbon disulfide is also an advantage. At 20° C., its viscosity is 0.32 centipoises. This value compares with about 20,000 centipoises and up for bitumen. The viscosities of solutions can be determined by experiment or calculated from standard formulas. Further enhancing its ability to extract bitumen, carbon disulfide can be employed in countercurrent equipment.

The cost of carbon disulfide is a major concern even though the reuse of solvent is assumed. To mine substantial quantities of oil sands cost-effectively requires that the solvent used, be cheap. Fortunately, carbon disulfide can be synthesized from plentiful materials that are found in the oil sands deposits. It can be produced in an electric furnace from elemental sulfur and petroleum coke. Alternatively, it can be formed from carbonyl sulfide, which in turn is made from sulfur dioxide and carbon monoxide.

The solution of bitumen in carbon disulfide is ultimately fractionated to recover the bitumen. This step is most easily accomplished by distillation. Bitumen has a high boiling point whereas carbon disulfide boils at 46.25° C. under 1 atmosphere pressure. Notwithstanding the ease of separation, some residual carbon disulfide can be expected to remain in the bitumen.

Because of the high viscosity of the solution, it is preferably treated before fractionating. This can be done through hydrotreating. This step entails the reaction of the bitumen solution with hydrogen at elevated temperatures, in the range of 200° C. to 300° C. A catalyst may or may not be used. Cobalt compounds, including cobalt-molybdenum alloys, have been found to be effective in this application.

The reaction that takes place when carbon disulfide is treated with hydrogen is shown by the following equation.

$$CS_2+4H_2 \rightarrow CH_4+2H_2S$$

where $CS_2$ is carbon disulfide, $H_2$ is hydrogen, $CH_4$ is methane, and $H_2S$ is hydrogen sulfide. The thermodynamics for this reaction is extremely favorable under operating conditions so that it goes to completion.

The hydrotreating step is integrated into the upgrading of bitumen. Because bitumen is so viscous, it cannot be pumped or processed in its existing state. Therefore, one of two processes is generally employed to reduce its viscosity: coking and hydrotreating. Both measures can be taken. The result is a synthetic crude oil that is acceptable for further processing.

A better understanding of the process can be gained by reference to FIG. 1. Oil sands, the ore process in the process, and the carbon disulfide are fed to extractor 1. The resulting solution is passed to hydrotreator 2, while the tailings are discarded. Bitumen from unit 2 is fractionated at unit 3 to produce synthetic crude oil. The carbon disulfide from the fractionator 3 is recycled to extractor 1.

Making improvements in the processing of oil sands is particularly urgent because the industry is expanding at a breakneck pace. Practices that have been accepted in the past cannot deliver the results demanded by current conditions. The present invention is ideal for meeting the tremendous growth that is forecast.

Example

The viscosity of a solution of bitumen in carbon disulfide was calculated using the following expression:

$$\log \Phi = x_A \log \Phi_A + x_B \log \Phi_B$$

where $\Phi$ is fluidity, the reciprocal of the coefficient of viscosity, and x is the mole fraction.

For a solution in which the mole fraction of bitumen is 0.1, the viscosity equals 0.90 centipoises. This result compares with the viscosity of 1.0 centipoises for water.

What is claimed is:

1. A process for the extraction of bitumen from oil sands comprising the steps of:

(a) contacting the oil sands with carbon disulfide to dissolve the bitumen, and separating solids from the solution;

(b) hydrotreating the resulting solution by heating it to a temperature in the range of 200° to 300° C. in the presence of hydrogen; and (c) fractionating the hydrotreated solution to recover bitumen.

2. A process as defined in claim 1 wherein the hydrotreating is conducted in the presence of a catalyst.

3. A process as defined in claim 2 wherein the catalyst is a cobalt-molybdenum alloy.

4. A process as defined in claim 1 wherein the step of hydrotreating is characterized by the following formula:

$$CS_2+4H_2 \rightarrow CH_4+2H_2S$$

where $CH_4$ is methane and $H_2S$ is hydrogen sulfide.

* * * * *